US005139057A

United States Patent [19]

Benedetti

[11] Patent Number: 5,139,057

[45] Date of Patent: Aug. 18, 1992

[54] APPARATUS FOR FILLING PRESSURE VESSELS WITH GASES, PARTICULARLY ACETYLENE GAS

[75] Inventor: Iginio Benedetti, Bientina Pisa, Italy

[73] Assignee: I.L.L. di Bagnoli Maria & C s.a.s., Pisa, Italy

[21] Appl. No.: 541,814

[22] Filed: Jun. 21, 1990

[30] Foreign Application Priority Data

Aug. 8, 1989 [IT] Italy ..... 45216 A/89

[51] Int. Cl.[5] ..... B65B 1/04

[52] U.S. Cl. ..... 141/18; 141/237; 141/3

[58] Field of Search ..... 141/3, 18, 237, 248, 141/243, 244, 245, 246, 247, 129, 279, 382, 171, 160, 140, 198, 138, 159, 141, 142; 198/465.2, 795

[56] References Cited

U.S. PATENT DOCUMENTS

| | | | |
|---|---|---|---|
| 1,949,536 | 3/1934 | Ferguson | 141/171 |
| 3,754,369 | 8/1973 | Copstead | 141/3 |
| 3,789,889 | 2/1974 | Riedel et al. | 141/140 |
| 4,556,091 | 12/1985 | Poulsen | 141/82 |
| 4,582,100 | 4/1986 | Poulsen | 141/83 |

*Primary Examiner*—Ernest G. Cusick
*Assistant Examiner*—David J. Walczak
*Attorney, Agent, or Firm*—Beveridge, DeGrandi & Weilacher

[57] ABSTRACT

A plurality of pressure vessels are filled with acetylene gas by an apparatus which has a gas delivery conduit with a plurality of delivery connections. A drive mechanism moves pressure vessel supports from a loading station to locations where each pressure vessel is located at and conducted to a respective gas delivery connection. The gas delivery conduit is stationary, but its mountings permit horizontal movement to avoid damage to the apparatus if the supports are accidentally moved when the pressure vessels are attached to the delivery connections. When the gas delivery conduit is displaced more than a certain amount from its normal stationary position, power to the drive mechanism is automatically cut off. The supports for the pressure vessels are oriented to house the pressure vessels at an inclination which maintains them steady. The disclosed drive mechanism has two pneumatic cylinders for driving the supports along a slide of a fixed structure.

23 Claims, 3 Drawing Sheets

APPARATUS FOR FILLING PRESSURE VESSELS WITH GASES, PARTICULARLY ACETYLENE GAS

BACKGROUND OF THE INVENTION

The present invention is concerned with an apparatus for filling pressure vessels with gases, particularly acetylene gas.

It is known that apparatus for filling pressure vessels with gases basically comprise stationary gas delivery conduits placed in an area which includes positions where the portable cylinders are positioned, alone or in sets, for the cylinder filling operations. These operations require a great deal of time and they also require highly skilled employees when the fluid treated in such apparatus is a dangerous one, due to the specific complexity of said operations.

In fact it is known that the filling of a portable cylinder of dissolved gas is carried out with a mixing operation wherein the gas has to be dissolved into a solvent which is already present in the cylinder. Such an operation needs to cope with the parameters which regulate the mixing and which vary according to the solvent and the solute type. The importance of said parameters requires that the cylinder filling operation be performed by an expert and qualified staff which also is able to correct any anomalous or dangerous situations that may arise.

Due to the length of time the cylinder filling operation needs, it is carried out on many gas-cylinders simultaneously. Each of them is weighed to verify the quantity of solvent it contains, then it is carried to the cylinder filling position where it is coupled by a flexible pipe to the delivery opening of the gas delivery conduit. After the cylinder filling operation has been completed and the gas delivery conduit has been discharged, each gas-cylinder is disconnected from the conduit and carried to a weighing scale to confirm that the amount of bottled gas is within the established limits.

From the foregoing, it can be seen that operations of great skill occur together with simple porterage operations. This increases the operation time, and it creates problems about the management of the staff since, unless unskilled employees are hired to be utilized only during the cylinder carrying operations (a small fraction of the time necessary for the process), the skilled employees are forced to do physically demanding tasks inappropriate to their degree of specialization.

Until now, the possibility of automatic movement of the gas-cylinders has been avoided for this type of apparatus. This possibility is utilized in other types of apparatus for filling pressure vessels, for example in apparatus concerned with liquified petroleum gases. These apparatus do not create particular problems with regard to safety since the pressure value is low and the cylinder filling operation may be carried out over few gas-cylinders automatically, by a continuous control of the weight, to offer a tangible profit in terms of management costs. As far as the apparatus for filling pressure vessels with dissolved gas, the technical problems to solve and the necessity for supervision of the operator have excluded the hypothesis of automatizing the systems.

The problems regarding the management of the staff, time saving and costs that would be achieved by automatization, have led to the present invention, whose main purpose is to provide an apparatus for filling pressure vessels with dissolved gas in which the tasks of carrying the gas-cylinders are eliminated, and the essential high grade of safety is guaranteed.

SUMMARY OF THE INVENTION

The invention is applicable to an apparatus which has a row of supports which are each shaped to receive at least one gas cylinder. A gas delivery conduit has a plurality of delivery connections for simultaneously supplying acetylene gas to a plurality of gas cylinders on their respective gas supports. There is a loading station where gas cylinders are each individually loaded onto a respective support, and there is a driving means for moving the supports horizontally from the loading station to positions where the gas cylinders on the supports are located at respective gas delivery connections of the gas delivery conduit.

According to one feature of the invention, the driving means includes a pneumatic cylinder. According to another feature of the invention, the supports are oriented to house their respective cylinders at an inclination which maintains th cylinders steady in their supports. Still another feature of the invention involves the presence of a visual indicating means for indicating the feeding condition of the driving means.

According to still another feature of the invention, the gas delivery conduit is stationary but is supported for horizontal movement to avoid damage to the apparatus if the supports are accidentally moved when the gas cylinders thereon are attached to the delivery connections. In connection with this feature, it is preferred to provide means for sensing horizontal movement of the gas delivery conduit, arranged to cut off power to the driving means when the sensing means detects that the gas delivery conduit has been displaced a certain amount from its normal position.

In the following, an exemplifying form of a practical embodiment of the present invention is disclosed, as illustrated in the hereto attached drawings.

DETAILED DESCRIPTION

Figure 1:
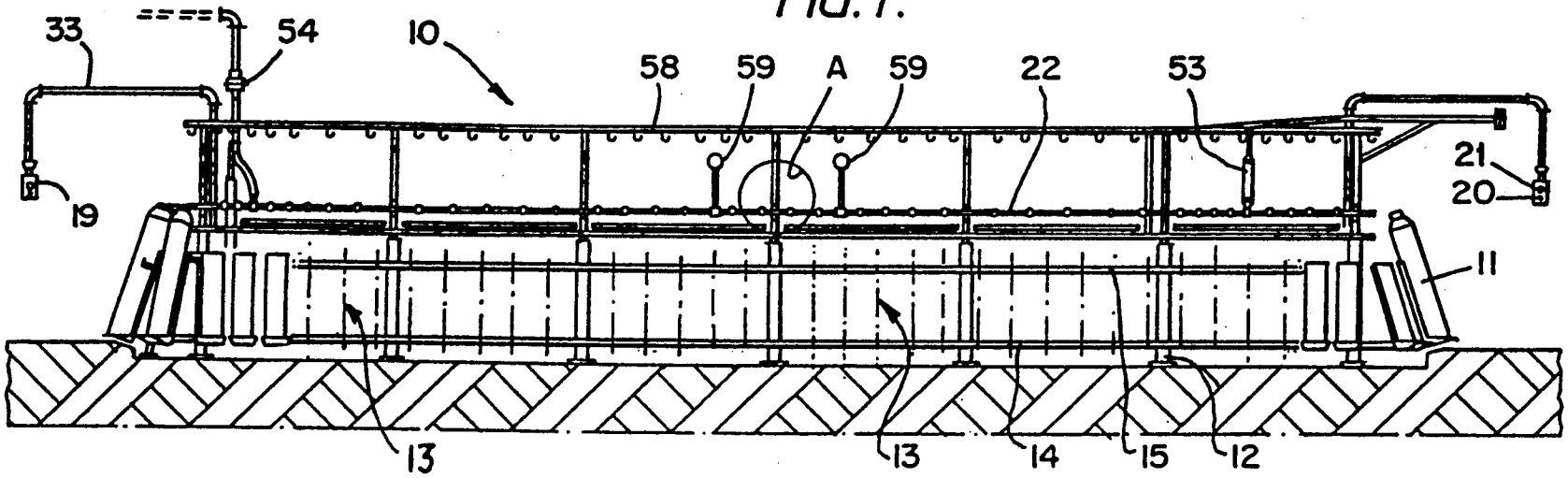
FIG. 1 shows a schematic side view of an apparatus according to the present invention.
Figure 2:
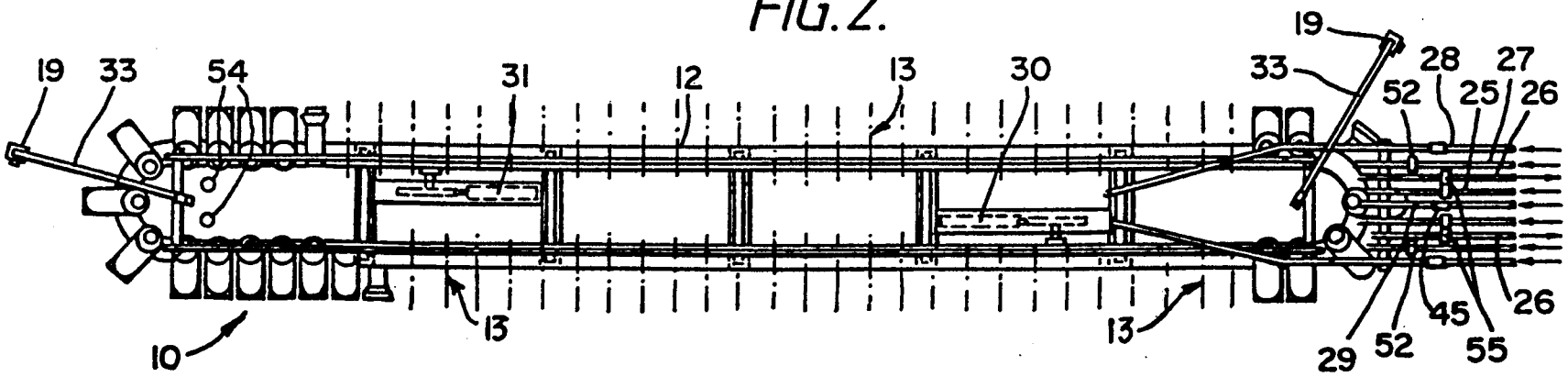
FIG. 2 shows a top view of an apparatus according to the present invention.
Figure 3:
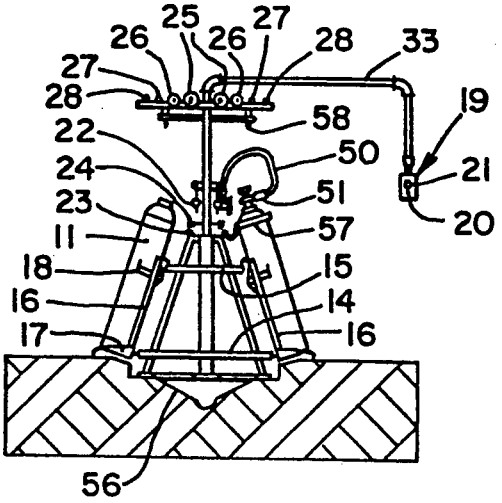
FIG. 3 shows an end view of the apparatus of FIG. 2.

In FIGS. 1, 2 and 3, reference numeral 10 identifies an apparatus for filling acetylene gas cylinders 11 which are illustrated only in a limited number for convenience of illustration. The positions occupied by all the cylinders on the fixed structure 12 are illustrated by the sketched axes 13. The fixed structure 12 includes two parallel slides, 14 and 15 which, as seen in FIG. 3, slidingly support the brackets 16 which house and support the cylinders 11. The brackets are shaped in such a way to house the cylinders firmly due to the inclination of the brackets. The cylinders 11 are supported by the base platforms 17, and their stability is also assured by the appendages 18 of the brackets 16.

The symmetry of the apparatus with reference to its central vertical plane is shown in FIG. 3; in fact, it can be verified that all the elements illustrated in FIG. 2 except the control box 19 housing the normal operation push buttons 20 and the emergency push-buttons 21, are replicated on both sides of the apparatus.

There are dual conduits 22 for acetylene delivery, dual conduits 23 for delivering cooling water, and dual conduits 24 for the fire suppression fluid.

As illustrated better in FIG. 2, dual conduits are also connected to the systems producing the gas. These connection conduits are illustrated in a very schematic way in FIG. 2 and in FIG. 3. In their function and in their structure, they are known in the art. They include the feeding conduit 25 and the discharging conduit 26 for the acetylene gas, the conduit 27 for feeding the fire suppression fluid, and the conduit 28 for feeding the cooling water.

The doubling of the conduits and delivery conduits of said fluids gives a high grade of flexibility to the apparatus, which can be linked to production systems of different power and furthermore allow the management of variable quantities of cylinders without affecting the times required for the cylinder filling operations. The safety of the apparatus is improved and it is guaranteed operative, even if partially, when there is a failure in one of the sections in which it is divided.

Figure 6:
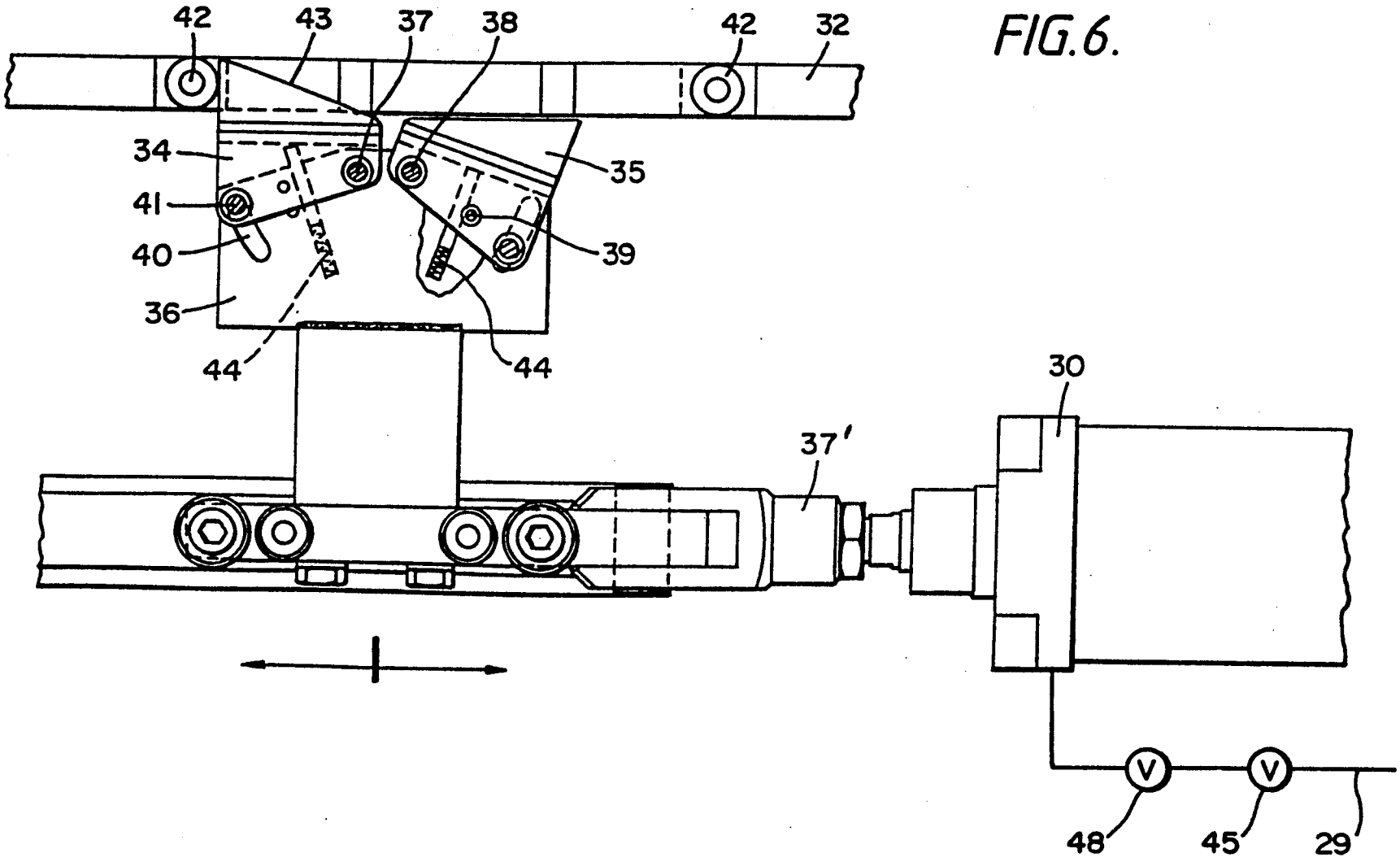
FIG. 6 shows a view in detail of a part of the driving means of an apparatus according to the present invention.

The only conduit which has not been doubled, since it would not have been useful to the above said aims, is the pneumatic conduit 29 which powers the driving means 30 and 31 which move the support brackets 16, linked to each other through an articulated member partially illustrated in FIG. 6.

In the illustrated example the feeding conduit 29 is a compressed-air conduit, since the two driving means 30 and 31 are two double effect pneumatic cylinders which are disposed on opposite sides of the apparatus, but which operate simultaneously since all the supporting brackets of the gas cylinders are joined together to form a single structure. Such a structure, as illustrated in FIG. 2, is shaped like a closed loop having two parallel adjacent sides linked up at their ends, said configuration being the most suitable to permit rational utilization of the apparatus. The weighing and loading station of the gas cylinders is put at one end while the discharging and final weighing station is put at the other end. Both of these areas are provided with control boxes 19 which control contemporarily the two pneumatic cylinders 30 and 31. The control boxes are mounted on swinging arms 33 to permit an easier use of them.

The positions of the pneumatic cylinders are such that it is preferable to actuate a counterclockwise movement of the gas cylinders, from the vantage point of FIG. 2. However if a clockwise movement is more suitable, it would be sufficient to invert the blockings of the ratchets 34 and 35 mounted on the plate 36 integral with the movable element 37' of the pneumatic cylinder 30. The same would be done for the ratchets of the cylinder 31.

As illustrated in FIG. 6, the ratchets 34 and 35 are pivoted on pins 37 and 38 on the plate 36. A plug 39 is used to block the ratchet 35 in the position shown. The ratchet 34 is free to rotate along an arc corresponding to the length of the slot 40 in which a plug 41, integral with the ratchet itself, is sliding. Rotation happens when the ratchet 34, after pushing one of the pins 42 of the chain 32 forward, is brought back to the original position during the backward stroke of the piston of the pneumatic cylinder 30. During this backward movement the inclined surface 43 of the ratchet strikes the next pin 42, causing the ratchet 34 to rotate down against the force of the elastic element 44, and then to come back to the position illustrated in the figure when said backward stroke is finished. In such a way, it is ready for the next operation. It is obvious that, by blocking the ratchet 34 and releasing the ratchet 35, the chain 32 and the gas cylinders linked to it are moved in a direction opposite to the previous one. The only difference is that in the first case the movement of the gas cylinders happens during the forward stroke of the piston of the pneumatic actuator 30, while in the second case, the working stroke is the backward one.

A device 45 to interrupt the flow of air is located at the input of the compressed-air conduit 29. In this specific case the device consists of a three-way valve which, when in closed position, vents the downstream part of the conduit 29 to the atmosphere. This prevents any movement of the cylinders 30 and 31 in the event of an accidental operation of the electrovalves of the pneumatic cylinders 30, 31.

In fact any risk of moving the gas cylinders when they are connected to the gas delivery conduits 22 has to be eliminated. Thus, the apparatus of the present invention is provided with a further safety feature which is effective even if the cylinders are accidentally moved during cylinder filling operations.

Figure 5:
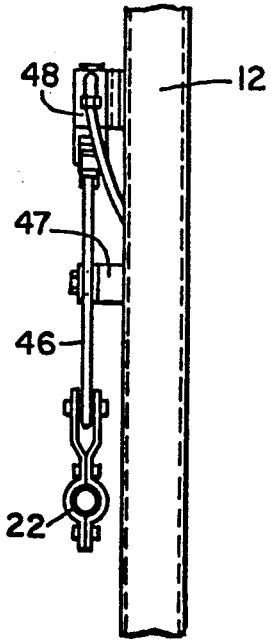
FIG. 5 shows a side view in section, in the plane illustrated in FIG. 4.
Figure 4:
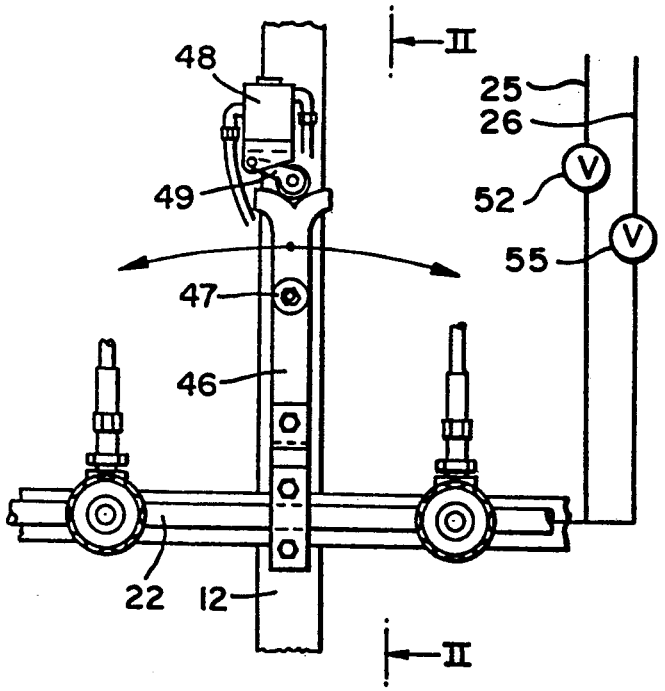
FIG. 4 shows a view in detail of the part of the apparatus indicated with A in FIG. 1.

As illustrated in FIGS. 4 and 5, the conduits 22 are suspended from the fixed structure 12 by hinges 46 swinging around fulcrums 47. The hinges permit only small movements of the conduits 22 to avoid stresses on the pipes 50, on the devices 51 and on the other components used for connecting the gas cylinders to the conduits in case the cylinders are accidentally moved when connected to the apparatus.

The hinge 46, in its swinging movement, activates a pneumatic microswitch 48 equipped with an elastic return element 49, which normally is located with its free end in a hollow on the upper end of the hinge 46.

The pneumatic microswitches 48, when activated, interrupt the power supply to the pneumatic cylinders 30 and 31, preventing the further movement of the gas cylinders 11 and preventing the above-mentioned stresses which are dangerous since they might cause a gas emission to occur.

To enhance the degree of safety in the apparatus in case of accidental movements of the gas cylinders, the emergency push-buttons 21, situated near the principal control push-buttons 20, block the pneumatic cylinders 30 and 31 by controlling their respective electrovalves.

Besides the above said specific safety devices, the apparatus is also provided with conventional safety devices normally used in this type of apparatus. In particular the valves used to prevent back-fire in the adduction conduits of anti-fire fluid are shown at 52. Silica disk type flame traps 53, operating in both directions, are used to isolate the production side from the delivery side of the gas conduit in case of a fire or an explosive decomposition of the acetylene, whether the fire or the explosive decomposition is initiated in the production side or in the delivery side. Blow out discs are placed along the gas delivery conduits as shown at 54. Flame trap devices 51 are mounted over each pipe 50 to prevent the spread of fire or explosive decomposition toward the delivery conduits 22. Unidirectional valves 55 are installed in the acetylene exit conduits 26 in such a way to direct any gas remaining in the conduits 22 towards a backgas tank at the end of the cylinder filling operations.

As illustrated in FIG. 3, the apparatus is provided with a backwater tank 56 to collect the cooling water which is delivered from the conduits 23 to each gas cylinder through usual toroidal rings 57, provided with small holes or openings which are placed on top of each cylinder when they are put on the brackets 16. FIG. 3 also shows a frame with a series of hooks 58 on which the flexible pipes 50 are normally hung when they are not connected to the gas cylinders 11.

Pressure gauges 59 (FIG. 1) are placed in the delivery conduits 22, both for checking the normal operation of the system and for verifying the absence of gas in the conduits when the pneumatic conduit 29 is fed through the three way valve 45.

Finally, the flexible pipes 50 are of the type in which there is an electric continuity from one end to the other to prevent electrostatic charges from accumulating along the inside walls of the pipes, to deter a destructive discharge through the walls.

The operation of the hereinabove disclosed apparatus is easily deducible from what has been already disclosed. After confirming that the delivery conduits 22 are empty of gas and after charging the pressure air conduit 29, each gas-cylinder is weighed by an usual weighing scale (not shown) and placed near one of the two ends of the structure 12. Then a gas cylinder is put on the nearest bracket 16 and one of the two push-buttons 20 is pushed, causing the chain of brackets 16 to advance only one step automatically, so that a new cylinder may be put on the apparatus. This sequence is repeated until the empty positions on the structure 12 are filled. Then, the pneumatic conduit 29 is vented by putting the three-way valve 45 in an off position. Each cylinder is connected to the delivery conduit 22 by a flexible pipe 50 and the respective tap is opened. Finally, when all the cylinders are connected to the delivery conduit, the acetylene delivery conduits 22 may be fed to start the real cylinder filling operation. During this last operation, the employed staff performs the usual controls and, if necessary, intervenes in case of an emergency according to the above disclosed modalities.

At the end of the cylinder filling operation, carried out in the predetermined period of time, the operator closes the acetylene delivery conduit and, after checking the pressure gauges to verify that the apparatus is completely empty of gas, he disconnects all the flexible pipes 50 and then operates the valve 45 to pressurize the air conduit 29 to the pneumatic cylinders 30 and 31. After that, he can remove each gas cylinder from the apparatus and check its weight, while using the control device 19 opposite to the one used when the gas cylinders were loaded on the apparatus. As a matter of convenience, the unloading station may be located at the opposite end of the apparatus from the loading station, but the two stations may also coincide.

As above disclosed, the advantages offered by the use of an apparatus according to the present invention are the reduction of the time, and consequently of the total costs of the cylinder filling operations, as well as the elimination of the manual moving of the gas cylinders.

Variations and modifications may be introduced in the above described solution. The gas-cylinders, for instance, may be retained in the brackets not only by their weight, but also by usual belts or chains linked to the lateral appendages 18 of the brackets.

The driving means may be of hydraulic or electromechanical, and the microswitches which sense the positions of the gas delivery conduits may be electric microswitches.

Each brackets may house more than one cylinder.

The slides 14 and 15 of the fixed structure may be covered with stainless steel or other wear proof material, along the contact zone with the sliding members integral with the cylinder supporting brackets. The sliding members may have a similar covering on their areas which are susceptible to wear.

The usual safety devices may vary as regards their structure and their operativeness according to the type of dissolved gas treated in the apparatus.

I claim:

1. Apparatus for filling gas cylinders with acetylene gas, comprising, a fixed structure, a row of supports which are horizontally movable relative to the fixed structure, each of said supports being shaped to receive at least one gas cylinder, a loading station where gas cylinders are each individually loaded onto one of said supports, a gas delivery conduit having a plurality of delivery connections each of which is attachable to a gas cylinder to simultaneously supply acetylene gas to a plurality of gas cylinders on their respective said supports, driving means for moving said supports from said loading station to positions where gas cylinders on a plurality of the supports are located at respective said gas delivery connections for connection thereto, said gas delivery conduit being stationary but being supported to permit horizontal movement of limited amount in the event that the supports are accidentally moved when the gas cylinders thereon are attached to the delivery connections.

2. Apparatus according to claim 1 including position-sensing means for sensing horizontal movement of said gas delivery conduit, and means for cutting off power to the driving means when said position-sensing means detects that the gas delivery conduit has been displaced a certain amount from its normal position.

3. Apparatus according to claim 2 wherein the position-sensing means includes a control lever which has an elastic return and which is actuated in response to relative movement between the gas delivery conduit and the fixed structure.

4. Apparatus according to claim 3 having flexible pipes which connect said delivery openings to the gas cylinders.

5. Apparatus according to claim 4 wherein the certain amount of displacement sensed by the position-sensing means is less than the amount of displacement required to place the flexible pipes under tension.

6. Apparatus according to claim 1 having two said gas delivery conduits which are movable relative to the fixed structure.

7. Apparatus according to claim 6 in which the fixed structure is shaped as a closed loop having two parallel sides joined at their ends, independent conduits feeding said two gas delivery conduits, said gas delivery conduits being parallel to each other, said fixed structure having a longitudinal axis which is near said gas delivery conduits.

8. Apparatus according to claim 7 wherein the driving means includes two pneumatic actuators located near ends of the parallel sides of the fixed structure, and main push-button control means for simultaneously controlling said pneumatic actuators.

9. Apparatus according to claim 8 in which two said main push-button control means are provided, said main push-button control means being located near both ends of the fixed structure.

10. Apparatus according to claim 9 having two emergency push-button control means for emergency interruption of the driving means, said emergency push-button control means being located respectively near the two main push-button control means.

11. Apparatus according to claim 10 wherein the fixed structure includes at least two slides, and the supports for the gas cylinders include sliding members which engage said slides, said slides and said sliding members being covered by wear proof material.

12. Apparatus according to claim 1 having a cooling conduit which carries cooling water to respective gas cylinders.

13. Apparatus according to claim 12 wherein the fixed structure includes a backwater tank for collecting cooling water.

14. Apparatus according to claim 1 wherein the gas delivery conduit has a flame trap device which divides the gas delivery conduit into a production side and a delivery side.

15. Apparatus according to claim 1 having overpressure safety devices located along the gas delivery conduit, said safety devices being calibrated to become disrupted at a given pressure to open the gas delivery conduit to the atmosphere.

16. Apparatus according to claim 1 having flexible pipes which connect said delivery openings to the gas cylinder, each of said flexible pipes being provided with means for preventing the propagation of fire or explosion toward the gas delivery conduit.

17. Apparatus according to claim 16 having a gas exit conduit for carrying gas from the gas delivery conduit to a tank at the end of a cylinder-filling operation, and one-way valves in said gas exit conduit.

18. Apparatus for filling gas cylinders with acetylene gas, comprising, a fixed structure, a row of supports which are horizontally movable relative to the fixed structure, each of said supports being shaped to receive at least one gas cylinder, a loading station where gas cylinders are each individually loaded onto one of said supports, a gas delivery conduit having a plurality of delivery connections for simultaneously supplying acetylene gas to a plurality of gas cylinders on their respective said supports, driving means for moving said supports from said loading station to positions where gas cylinders on a plurality of the supports are located at respective said gas delivery connections for connection thereto, said supports being oriented to house their respective cylinders at an inclination which maintains the cylinders steady in said supports.

19. Apparatus for filling gas cylinders with acetylene gas, comprising, a fixed structure, a row of supports which are horizontally movable relative to the fixed structure, each of said supports being shaped to receive at least one gas cylinder, a loading station where gas cylinders are each individually loaded onto one of said supports, a gas delivery conduit having a plurality of delivery connections for simultaneously supplying acetylene gas to a plurality of gas cylinders on their respective said supports, driving means for moving said supports from said loading station to positions where gas cylinders on a plurality of the supports are located at respective said gas delivery connections for connection thereto, said driving means including a pneumatic cylinder.

20. Apparatus according to claim 19 having ratchet devices which are connected to and moved by said pneumatic cylinder, and members on said supports which are engagable by said ratchets to move said supports and their respective gas cylinders.

21. Apparatus according to claim 19 including means for cutting off the power to said pneumatic cylinder by reducing to zero the pressure of air supplied to the pneumatic cylinder.

22. Apparatus for filling gas cylinders with acetylene gas, comprising, a fixed structure, a row of supports which are horizontally movable relative to the fixed structure, each of said supports being shaped to receive at least one gas cylinder, a loading station where gas cylinders are each individually loaded onto one of said supports, a gas delivery conduit having a plurality of delivery connections for simultaneously supplying acetylene gas to a plurality of gas cylinders on their respective said supports, driving means for moving said supports from said loading station to positions where gas cylinders on a plurality of the supports are located at respective said gas delivery connections for connection thereto, said apparatus including visual indicating means for indicating the feeding condition of the driving means.

23. Apparatus according to claim 22 having a pneumatic conduit for feeding the driving means, and said visual indicating means is a pressure indicator.

* * * * *